United States Patent [19]

Miyanaka et al.

[11] 4,404,616

[45] Sep. 13, 1983

[54] IGNITING AND FLAME DETECTING DEVICE

[75] Inventors: Motoshi Miyanaka; Kenzi Toudo, both of Yanai, Japan

[73] Assignee: Hitachi, Ltd., Tokyo, Japan

[21] Appl. No.: 250,643

[22] Filed: Apr. 3, 1981

[30] Foreign Application Priority Data

Apr. 16, 1980 [JP] Japan ..... 55/49211

[51] Int. Cl.[3] ..... F23Q 3/00

[52] U.S. Cl. ..... 361/253; 340/579; 431/264

[58] Field of Search ..... 361/253, 256, 257, 91, 361/112; 315/119, 123, 127; 340/577, 579; 431/258, 264

[56] References Cited

U.S. PATENT DOCUMENTS 3,740,574 6/1973 Taylor ..... 340/579
3,795,840 3/1974 Cambra ..... 361/91
4,238,184 12/1980 Schilling ..... 340/579

FOREIGN PATENT DOCUMENTS 54-50777 4/1979 Japan .

*Primary Examiner*—C. C. Shaw
*Attorney, Agent, or Firm*—Antonelli, Terry & Wands

[57] ABSTRACT

There is disclosed an igniting and flame detecting device of one rod type having an electrode used for generating a spark for firing gas from a burner and also for supplying an AC voltage for detecting a flame generated by the firing, in which a pulse generating transformer is provided for generating the spark at the electrode with its secondary coil connected in series with the electrode through a discharge tube, a flame detection transformer is provided to apply AC voltage to the flame generated by firing the gas from burner with its secondary coil connected in series with a resistor and a capacitor to form a series circuit which is connected in parallel with the discharge tube, a detection circuit is provided to detect DC voltage component produced, due to rectifying effects of the flame, across the capacitor, and a gap discharge element having a discharge starting voltage which is higher than a normal discharge starting voltage of the discharge tube is connected in parallel with the discharge tube, whereby the spark generation at the electrode and the flame detection can be effected reliably.

6 Claims, 2 Drawing Figures

IGNITING AND FLAME DETECTING DEVICE

This invention relates to an igniting and flame detecting device of rod type in which an electrode is used for both igniting and flame detecting.

A device of this type, as disclosed, for example, in Japanese utility model application No. 123318/77 filed on Sept. 13, 1977 and published for public inspection on Apr. 7, 1979 as Kokai No. 50777/79, comprises a pulse generator circuit which is adapted to generate a high voltage between an electrode and the burner for firing fuel gas discharged from a burner, a flame detection circuit adapted to apply an AC voltage across the electrode and the burner and detect a DC current accruing due to rectifying effects of the flame generated by firing the gas, and a discharge tube such as a neon lamp connected to the input terminal of the flame detection circuit in order to by-pass the ignition discharge current and thus protect the flame detection circuit from the ignition high voltage.

The discharge tube or the neon lamp used in the aforementioned device has a relatively large gap between discharge electrodes and hence continues to exhibit a negligible inter-electrode leakage current even after a longtime operation. Accordingly, the discharge tube can advantageously be connected to the input terminal of the flame detection circuit adapted to detect a small flame current accruing due to the rectifying effects of the flame, without reducing the sensitivity of the flame detection circuit. However, it has been found that the neon tube involves a problem such that the electrodes of the tube are subjected, when used for a long time, to blacking or carbonizing with a result that the electron emission capacity of the tube becomes degraded and unstable. Consequently, the discharge tube, when it receives a steeply rising high voltage pulse from the pulse generator circuit, tends to discharge at the level of the high voltage pulse, which is unstable and higher than the normal rating discharge voltage level at which the neon lamp normally starts to discharge and, as a result, the discharge is delayed and a false flame signal may be generated which is responsible for malfunction of the associated system.

It is therefore an object of this invention to provide an igniting and flame detecting device which can effectively make use of the above mentioned excellent properties of the discharge tube while compensating for its drawbacks.

To accomplish the above object, according to the invention, a gap discharge element is connected in parallel with the discharge tube, the element having a stable discharge starting voltage which is higher than the normal rating discharge voltage of the discharge tube.

Figure 1:
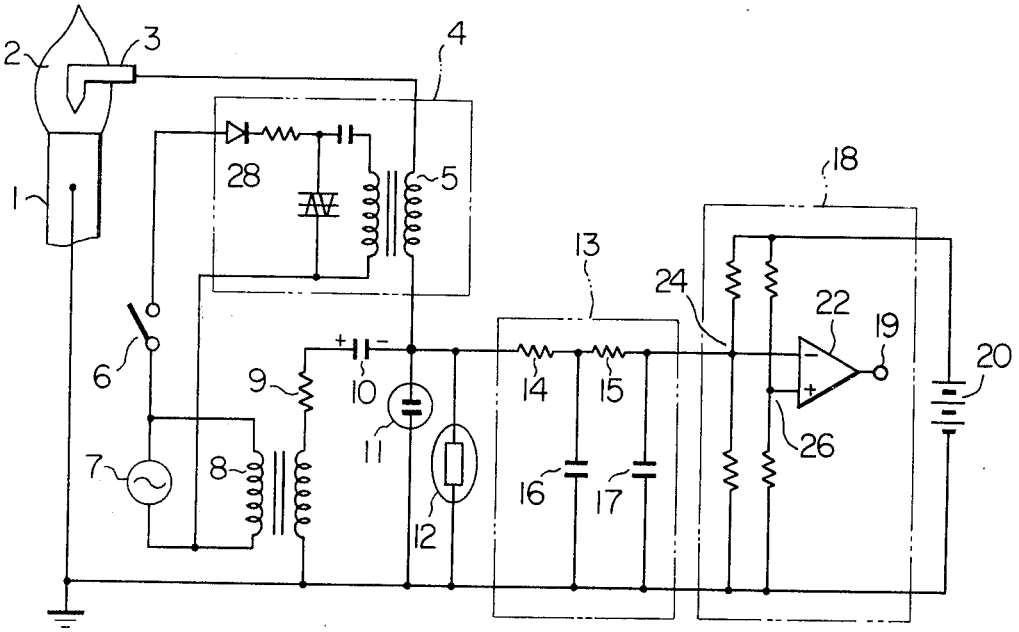
Figure 2:
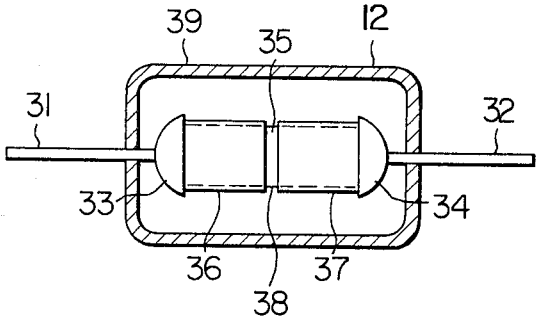

The objects and features of the present invention will be well understood from the following description of a preferred embodiment in conjunction with the accompanying drawings in which:

FIG. 1 is a circuit diagram of an igniter and flame detector arrangement embodying the invention; and FIG. 2 is a side view, partly sectioned, of a gap discharge element constructed in accordance with teachings of the invention.

Referring now to FIG. 1 illustrating an igniting and flame detecting device of the invention, 1 is a burner, 3 a single electrode used for both igniting and flame detecting, 2 a flame generated when gas from the burner is fired, 4 a well known pulse generator circuit incorporating a pulse transformer 5 having a secondary winding connected to the electrode 3, 8 a flame detecting transformer to which the pulse generator circuit 4 is connected in such a manner that the high voltage generated by the pulse transformer 5 is in opposite phase relationship with a flame current to be described later, 6 an ignition switch connected to a commercial AC power source 7 of, for example, 100 V at 50 Hz, 9 a resistor and 10 a capacitor. The transformer 8, resistor 9 and capacitor 10 connected in circuit to the power source 7 constitute an AC power supply for an AC voltage to be applied to the flame 2, 11 is a neon lamp, 12 a gap discharge element connected in parallel with the lamp 11 and having a higher discharge starting voltage than the normal rating discharge voltage of the neon lamp 11, 13 a two-stage low-pass filter circuit comprised of resistors 14 and 15 and capacitors 16 and 17, 18 a well known flame detection circuit adapted to detect a negative voltage developed due to the rectifying effects of the flame for determining the presence or absence of the flame and to deliver a signal according to that determination to an output terminal 19, and 20 a DC power supply.

The gap discharge element 12 has, as shown in FIG. 2, an elongated ceramic member 35 which is supported by gap electrodes 33 and 34 having lead wires 31 and 32 and which is partly coated with electrically conductive films 36 and 37 so as to form a central portion of the ceramic member having no conductive film coating which serves as a narrow gap 38. The gap discharge element 12 as a whole is encapsulated with a glass enclosure 39 in which inert gas such as neon is filled.

In operation, a secondary voltage of the transformer 8 included in the power supply for flame detection is applied via resistor 9, capacitor 10 and transformer 5 to the electrode 3 opposing the electrically conductive burner 1. When the ignition switch 6 is turned on, a pulse voltage boosted by the pulse transformer 5 is delivered from the pulse generator circuit 4 and used for producing a spark at a gap between the electrode 3 and burner 1. Discharge current thus flows through a closed circuit of the secondary coil of pulse transformer 5—electrode 3—burner 1—neon lamp 11 now discharged. Once this high voltage discharge fires the gas from the burner thereby producing flame 2, the AC voltage fed from the flame detection transformer 8 is rectified by the flame 2 and a DC current (hereinafter referred to as a flame current) begins to flow from the electrode 3 to the burner 1 via the flame 2. The flame current is integrated through an integrating circuit composed of the resistor 9 and the capacitor 10 thereby charging the capacitor with its electrode connected to the resistor 14 being at a negative potential. This negative potential or voltage is detected, after being filtered through the low-pass filter circuit 13 by the flame detection circuit 18. Following the detection of the flame by the flame detection circuit 18, the ignition switch 6 is turned off.

Since the neon lamp 11 has a lower discharge starting voltage than that of the gap discharge element 12, the secondary current of the pulse transformer 5 normally flows through the neon lamp 11. The neon lamp 11 will start to discharge when its terminal voltage is increased in response to the activation of the pulse generator circuit 4. The neon lamp 11, however, has a large inter-electrode gap and its electrodes tend to develop blacking of their surfaces, whereby the ability of the electrodes to emit electrons is degraded. As a result, depending on the state of electron emission inside the lamp, the neon lamp, which is activated to discharge by a steep rising high voltage pulse of the pulse generator circuit 4, tends to discharge at a higher level of the high voltage pulse than that of its rated discharge voltage, resulting in a delayed discharge. Because of the delayed discharge, the high voltage at high frequency is integrated by the integrating circuit including the resistor 9 and the capacitor 10 to develop a DC negative voltage at the junction to the resistor 14. Thus, this negative voltage results in a false flame signal in the absence of the flame and causes the system associated with the flame detection circuit to operate erroneously. To prevent such erroneous operations, the gap discharge element 12 is connected in parallel with the neon lamp 11 to ensure that a high terminal voltage at the neon lamp 11 produced due to failure of discharging of the neon lamp can be discharged supplementarily. In the gap discharge element 12 having the construction as shown in FIG. 2, a discharge first takes place at the narrow gap 38 as the electric field increases and thereafter prevails across the gap electrodes 33 and 34, thus preventing the delayed discharge as occurred in the neon lamp 11.

Typically, the neon lamp 11 is designed to start its discharge at about 110 V if it is normal, namely, it is not subjected to blacking, whereas the gap discharge element 12 is designed to start its discharge at about 400 V. Obviously, when the burner gas is fired by a spark between the electrode and the burner with the discharge through the gap discharge element 12, the DC negative voltage at the capacitor 10 develops as in the case of discharge of the neon lamp 11 and is applied via the low-pass filter circuit 13 to the flame detection circuit 18.

The flame detection circuit 18 has a comparator 22 having a first input terminal connected to receive a voltage appearing at an intermediate terminal 24 of a resistor circuit connected across the DC power source 20 and a second input terminal connected to receive a voltage appearing at an intermediate terminal 26 of another resistor circuit connected in parallel to the first resistor circuit. The potential at the terminal 26 is slightly lower than the potential at the terminal 24 in the absence of the flame 2 and hence with no DC negative voltage at the capacitor 10 so that the output terminal 19 of the comparator is at a low level. When the flame 2 takes place and a negative voltage develops at the capacitor 10, the potential at the terminal 24 falls below the potential at the terminal 26 so that the output terminal 19 turns to a high level. A signal representative of this high level may be coupled to an associated system (not shown) and used for controlling the same. Without occurrence of the flame, the low level at the output terminal 19 remains. For example, if the output terminal 19 remains at the low level even at the termination of a predetermined time period following the closure of the switch 6, the system may be deactivated automatically.

In this manner, no abnormally high voltage develops at the input terminal of the low-pass filter circuit 13 in the event that the discharge of the neon lamp 11 is delayed and therefore the flame detection circuit 18 detects the presence of the flame current accurately.

It may be considered that only the gap discharge element 12 may be used for discharging the pulse voltage generated by the pulse generator circuit 4 without any need for the neon tube. The gap discharge element, however, has a narrow gap and hence it will not take long before a substantive leakage resistance is developed due to sputtering by discharge in the gap discharge element. Since the flame current produced due to the rectifying effects of the flame is very small on the one hand and the flame detection circuit has a relatively high impedance on the other hand, the leakage resistance thus developed will cause the sensitivity of the flame detection circuit to decrease. For this reason, the gap discharge element alone is not practical for the device to be used for a long time.

The discharge tube such as neon lamp having a large inter-electrode gap develops no substantive leakage resistance even when it is operated frequently but the discharge tube suffers from the delayed discharge as described hereinbefore.

The foregoing embodiment overcomes this problem because the neon lamp 11 having a discharge starting voltage whose level is normally lower than that of the gap discharge element 12 is activated in the normal operation and the gap discharge element 12 is activated only when the delayed discharge in the neon lamp 11 takes place, thereby minimizing the effects of sputtering across the electrodes of the gap discharge element 12 and hence preventing it from developing such substantive leakage resistance.

As has been described, the invention utilizes in combination a discharge tube such as a neon lamp which tends to suffer from the delayed discharge but not from developing of substantive leakage resistance, even after frequent operations, due to the large inter-electrode gap and the gap discharge element which would, if activated frequently, suffer from developing of such substantive leakage resistance but not from the delayed discharge due to the narrow inter-electrode gap in such a manner that the discharge tube is brought into activation more frequently than the gap discharge element by setting the normal discharge starting voltage of the discharge tube at a lower level than that of the gap discharge element, whereby the present invention provides an igniting and flame detecting device of the one rod type which can operate reliably over a long period of operation.

What is claimed is:

1. An igniting and flame detecting device comprising:

electrode means disposed close to a burner for producing a spark for firing gas issuing from the burner;

high voltage pulse generating means connected in series with said electrode means through a discharge tube for applying a high voltage pulse to said electrode means through said discharge tube;

flame detecting means for detecting the presence or absence of a flame produced when the gas is fired based on rectifying effects of the flame, said detecting means including a series circuit composed of flame detection AC means, a resistor and a capacitor and connected in parallel with said discharge tube for applying an AC voltage to said flame through said high voltage pulse generating means, and a detection circuit connected to said series circuit for detecting a DC voltage component produced across said capacitor due to the rectifying effects of said flame; and a gap discharge element connected in parallel with said discharge tube and designed to start its discharge at a voltage level which is higher than a voltage level at which said discharge tube normally starts its discharge.

2. An igniting and flame detecting device according to claim 1 wherein said high voltage pulse generating means comprises a pulse transformer having a primary coil connected to an AC power source and a secondary coil for producing a high voltage pulse and connected in series with said discharge tube and said electrode means, and wherein said flame detection AC means comprises a flame detection transformer having a primary coil connected to said AC power source and a second coil connected in series with said resistor and said capacitor to form the series circuit which is in parallel with said discharge tube.

3. An igniting and flame detecting device according to claim 1 or 2 wherein said discharge tube is a neon lamp and said gap discharge element is of the type which includes a pair of spaced discharge gap electrodes and an elongated ceramic member mounted across said pair of electrodes and coated thereon with electrically conductive films except for its center portion having no coating of the electrically conductive film so as to provide a narrow discharge gap.

4. In an igniting and flame detecting device having pulse generator means including a pulse tranformer with a secondary output winding for generating a voltage which is high enough to produce an ignition spark across electrode means to ignite gas issuing from a burner; a gas discharge tube connected in series with said secondary winding of said pulse generator means across said electrode means; and flame detecting means connected in parallel with said gas discharge tube for detecting the presence or absence of a flame produced when the gas issuing from the burner is fired based on rectifying effects of the flame; the improvement comprising a gas discharge element connected in parallel with said gas discharge tube and having a starting discharge voltage level which is higher than the starting discharge voltage level of said gas discharge tube.

5. An igniting and flame detecting device according to claim 4 wherein said gas discharge tube and said gap discharge element have different discharge characteristics from each other.

6. An igniting and flame detecting device according to claim 4 wherein said discharage tube is a neon lamp and said gap discharge element is of the type which includes a pair of spaced discharge gap electrodes and an elongated ceramic member mounted across said pair of electrodes and coated thereon with electrically conductive films except for its center position having no coating of the electrically conductive film so as to provide a narrow discharge gap.

* * * * *